US006126080A

United States Patent [19]

Wada

[11] Patent Number: 6,126,080

[45] **Date of Patent: *Oct. 3, 2000**

[54] AIR CONDITIONER

[75] Inventor: Keiji Wada, Oizumi-machi, Japan

[73] Assignee: Sanyo Electric Co., Ltd., Moriguchi, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/948,272

[22] Filed: Oct. 9, 1997

[30] Foreign Application Priority Data

| | | | |
|---|---|---|---|
| Oct. 18, 1996 | [JP] | Japan | 8-297113 |
| Oct. 18, 1996 | [JP] | Japan | 8-297115 |
| Oct. 18, 1996 | [JP] | Japan | 8-297117 |

[51] Int. Cl.[7] ..... G05D 23/00; F24F 11/00

[52] U.S. Cl. ..... 236/51; 62/175; 165/207

[58] Field of Search ..... 236/51; 62/175; 165/208, 207, 209

[56] References Cited

U.S. PATENT DOCUMENTS

| | | | |
|---|---|---|---|
| 4,333,316 | 6/1982 | Stamp, Jr. et al. | 236/51 X |
| 5,271,453 | 12/1993 | Yoshida et al. | 236/51 X |
| 5,383,336 | 1/1995 | Nishida et al. | 236/51 X |
| 5,435,147 | 7/1995 | Mochizuki et al. | 236/51 X |
| 5,595,342 | 1/1997 | McNair et al. | 236/51 |
| 5,647,223 | 7/1997 | Wada et al. | 236/51 X |

*Primary Examiner*—Harry B. Tanner
*Attorney, Agent, or Firm*—Darby & Darby

[57] ABSTRACT

In an air conditioner including an outdoor unit and plural indoor units, the outdoor unit is provided with an indoor unit operation setting mechanism for setting the driving operation of the indoor units, and the indoor unit operation setting mechanism is provided with operation control parameter changing means for changing the storage content of storage means of each indoor unit and/or master/slave setting means for automatically performing the master/slave setting operation of the indoor units.

10 Claims, 8 Drawing Sheets

FIG. 9A

| 1 | 2 | 3 | 4 | 5 |
|---|---|---|---|---|
| OUTDOOR UNIT 3 | INDOOR UNIT 1a | RELAYED | ALL INDOOR UNIT | CHECK SET DATA |

FIG. 9B

| 1 | 2 | 3 | 4 | 5 |
|---|---|---|---|---|
| INDOOR UNIT 1a | ALL INDOOR UNIT | NORELAY | OUTDOOR UNIT 3 | CHECK SET DATA |

FIG. 9C

| 1 | 2 | 3 | 4 | 5 |
|---|---|---|---|---|
| INDOOR UNIT 1b | INDOOR UNIT 1a | RELAYED | OUTDOOR UNIT 3 | UNSETTLED |

FIG. 9D

| 1 | 2 | 3 | 4 | 5 |
|---|---|---|---|---|
| INDOOR UNIT 1c | INDOOR UNIT 1a | RELAYED | OUTDOOR UNIT 3 | UNSETTLED |

FIG. 9E

| 1 | 2 | 3 | 4 | 5 |
|---|---|---|---|---|
| INDOOR UNIT 1a | OUTDOOR UNIT 3 | NORELAY | INDOOR UNIT 1b | UNSETTLED |

FIG. 9F

| 1 | 2 | 3 | 4 | 5 |
|---|---|---|---|---|
| INDOOR UNIT 1a | OUTDOOR UNIT 3 | NORELAY | INDOOR UNIT 1c | UNSETTLED |

AIR CONDITIONER

BACKGROUND OF THE INVENTION

1. Field of the Invention

The present invention relates to an air conditioner in which various setup operations for plural indoor units such as an operation for setting control parameters of the indoor units, a master-slave setup operation for setting the master-slave relationship between the indoor units, etc. can be performed through a controller of an outdoor unit which is connected to the indoor units.

2. Description of the Related Art

In an air conditioner, a control board is generally provided in each control unit of an indoor unit and an outdoor unit. The control board has a CPU (Central Processing Unit), a ROM (Read-only Memory) and other parts mounted thereon, and the CPU accesses various control programs from the ROM to control the driving of various units in the indoor unit and the outdoor unit.

There have recently appeared such an air conditioner that the operation control parameter of an indoor unit can be changed in accordance with a user's request, variation of a use condition or the like. For example, when cooling operation (or heating operation) is interrupted (thermo-off) because the room temperature is coincident with a target temperature, a use may wish to stop air blowing. Further, even when an office and a studio are located in the same building, the dog progress speed of an air filter is different between the office and the studio due to the difference of the amount of floated dust, so that it is preferable that an alarming interval for instructing a filter cleaning work is variable. Normally, the operation control parameters are stored in a non-volatile memory (EEPROM) or the like of the controller of the indoor unit, and the change of these operation control parameters are performed through a remote controller which is provided to each indoor unit.

In the conventional air conditioner as described above, when the operation control parameter is changed, an operator must go to each room in which each indoor unit is mounted and operate the remote control inherent to the indoor unit of the room. However, several tens indoor units are generally mounted in a big office building, a big store or the like, so that a large number of working steps containing movement between rooms are needed to change the operation control parameters of all the indoor units.

Further, with respect to indoor units which are controlled by means of a centralized controller or like (i.e., non-remote-control type indoor units), each indoor unit is provided with no remote controller, and thus the change of the operation control parameter must be performed by preparing a preliminary remote controller and connecting it to each indoor unit.

Still further, the target temperature of a heat exchanger to a set room temperature, the driving rotational number of an air blowing fan to a demanded air quantity, the driving timing of supplementary equipment (humidifier, heater, etc.), etc. are varied between indoor units due to the difference in type (model, capacity), and thus the operation control parameter in conformity with each type is needed individually. In addition, the control board as described above is designed on the assumption that it is commonly used for many types of indoor units. Therefore, various operation control parameters which are respectively matched with various types are collectively stored in the ROM so that a suitable operation control parameter can be selected and used in accordance with a type in which the control board is actually mounted.

The types of indoor units of air conditioners have been recently diversified due to diversified requirements for air condition, and it is now classified into about twenty models such as an in-ceiling type, a floor-mount type, etc. Further, the capacity is set to about ten levels for even indoor units of the same model in accordance with the capacity of a space to be air-conditioned. Accordingly, the number of the types of indoor units is increased to a value in the range from one hundred and several tens to several hundreds. When the same control board is used for each of all the indoor units, the amount of operation control parameters to be stored in ROM of the control board is increased to cover all the types of indoor units and thus it is increased to an extremely large value although only one type of indoor units are actually mounted. Accordingly, a large-capacity ROM must be used, resulting in increase of the manufacturing cost of the overall indoor unit. In view of the foregoing, it has been proposed to setup an exclusively-used control board every type or model of an indoor unit. However, in this case, the types of control boards must be aimlessly diversified, and a production management, an inventory management, etc. become cumbersome. In addition, the manufacturing cost of an indoor unit also rises up because the volume of production is relatively low and there are wide variety of products to be made (i.e., flexible manufacturing system).

Furthermore, a so-called multiroom type air conditioner in which plural indoor units are connected to one outdoor unit has been increasingly required to be set up in a big office building, etc. According to a multiroom air conditioner, each indoor unit may be independently controlled by a remote controller or the like as described above, however, in many cases indoor units which are mounted in the same space to be air-conditioned are grouped and managed under the group control. When indoor units are grouped, it is necessary to set one of the grouped indoor units as a master unit and set the other grouped indoor units as slave units. The master unit of the indoor unit group communicates with a remote controller or an outdoor unit, and further transmits an operation setting (parameters) to the slave units, whereby all the indoor units of the indoor unit group are controlled on the basis of the same operation setting (parameters).

In general, the indoor units are designed in the same construction, and a master/salve change-over switch is provided in the control device of each indoor unit. When a master/slave setting work is performed on the indoor units, a setup operator switches the change-over switch to a master or slave mode every indoor unit to individually set each indoor unit as a master unit or a slave unit.

In the above-described conventional air conditioner, the following problem occurs because the master/slave setting work for each indoor unit group is performed by the setup operator. That is, when the setup operator makes an error to the switching operation, there may occur such a case that plural master units are set for one indoor unit group or all the indoor units are set as slave units. In this case, control signals are mingled between the indoor units and the group control is not performed, so that the setup operation must be quickly corrected. However, when the indoor units are of an in-ceiling type or a built-in duct type, it is very difficult to access to the indoor units after these indoor units are mounted, and thus a large number of steps and a setup time are needed for a re-setup work.

SUMMARY OF THE INVENTION

The present invention has been implemented in view of the foregoing condition, and has a first object to provide an air conditioner in which a work for changing operation control parameters of indoor units can be easily performed in a short time.

Further, the present invention has a second object to provide an air conditioner in which operation control parameters stored in a control board at an outside unit are transmitted to an indoor unit side to establish common use of a control board for indoor units, thereby reducing the manufacturing cost of the indoor units.

Still further, the present invention has a third object to provide an air conditioner in which an outdoor unit can automatically perform a master/salve setting work for an indoor unit group.

In order to attain the above objects, according to a first aspect of the present invention, an air conditioner including an outdoor unit and plural indoor units connected to the outdoor unit, is characterized in that the outdoor unit is provided with indoor unit operation setting means for setting the operation of each indoor unit.

According to the air conditioner as described above, an operator can perform the operation setting (control) of the indoor units without going to each room by merely inputting from a controller of the outdoor unit side various information such as an unit number, change values of operation control parameters, data necessary for master/slave setting between the indoor units.

According to a second aspect of the present invention, in the air conditioner of the first aspect, non-volatile storing means for storing therein an operation control parameter of each indoor unit is provided in driving control means of each indoor unit, and the indoor unit operation setting means of the outdoor unit is provided with operation control parameter changing means for changing the storage content of the non-volatile storing means of each indoor unit every individual indoor unit.

According to the above-described air conditioner, an operator can set the operation control parameter of each indoor unit individually without going to each room by merely inputting an unit number and a change value of the operation control parameter from a controller of the outdoor unit side.

According to a third aspect of the present invention, in the air conditioner of the first aspect, non-volatile storing means for storing an operation control parameter of each indoor unit is provided in driving control means of each indoor unit, and the indoor unit operation setting means of the outdoor unit is provided with operation control parameter changing means for collectively change the storage contents of the non-volatile storing means of all the indoor units.

According to the above-described air conditioner, an operator can collectively set the operation control parameters of all the indoor units without going to each room by merely inputting an unit number and a change value of the operation control parameter from a controller of the outdoor unit side.

According to a fourth aspect of the present invention, in the first air conditioner, the plural indoor units are grouped into at least one indoor unit group, non-volatile storing means for storing an operation control parameter of each indoor unit is provided in driving control means of each indoor unit, and the indoor unit operation setting means is provided with operation control parameter changing means for changing the storage contents of the non-volatile storing means of the indoor units every each indoor unit group.

According to the above-described air conditioner, an operator can collectively set the operation control parameters of the indoor units every indoor unit group without going to each room by merely inputting an unit number and a change value of the operation control parameter from a controller of the outdoor unit side.

According to a fifth aspect of the present invention, in the air conditioner of the first aspect of the presents invention, the outdoor unit is designed to be connectable to different types of indoor units, and the indoor unit operation setting means of the outdoor unit includes storing means for storing plural sets of operation control parameters which are respectively matched with plural types of indoor units, type identifying means for identifying the type of each indoor unit on the basis of an input signal from each indoor unit connected to the outdoor unit, operation control parameter selecting means for selecting an operation control parameter corresponding to the type of the indoor unit concerned from the storing means on the basis of the identification result of the type identifying means, and operation control parameter output means for outputting the selected operation control parameter to the indoor unit concerned.

According to the above air conditioner, many operation control parameters corresponding to the respective types of indoor units are beforehand stored in the storing means of the outdoor unit, an operation control parameter of each indoor unit connected to the outdoor unit is selected on the basis of the identification result of the type identifying means by the operation control parameter selecting means, and the selected operation control parameter is output to the indoor unit concerned by the operation control parameter output means.

According to a sixth aspect of the present invention, an air conditioner having an outdoor unit which is connectable with different types of indoor units, is characterized in that driving control means of the outdoor unit is provided with storing means for storing plural operation control parameters which are respectively matched with plural types of indoor units, type identifying means for identifying the type of each indoor unit on the basis of an input signal from each indoor unit connected to the outdoor unit, operation control parameter selecting means for selecting an operation control parameter corresponding to the type of the indoor unit concerned from the storing means on the basis of the identification result of the type identifying means, and operation control parameter output means for outputting the selected operation control parameter to the indoor unit concerned, and driving control means of each indoor unit is provided with writable storing means for storing the operation control parameter input from the outdoor unit connected to the outdoor unit, whereby the operation control of the indoor unit is performed on the basis of the operation control parameter stored in the writable storing means.

According to the above-described air conditioner, many operation control parameters which are respectively matched with the respective types of the indoor units are beforehand stored in the storing means of the outdoor unit, an operation control parameter of each indoor unit connected to the outdoor unit is selected on the basis of the identification result of the type identifying means by the operation control parameter selecting means, and the selected operation control parameter is output to the indoor unit concerned by the operation control parameter output means. At the indoor unit side, the input operation control parameter is written into the writable storing means to perform the operation control of each equipment on the basis of the parameter.

According to a seventh aspect of the present invention, an air conditioner includes an outdoor unit and plural indoor units which are connected to the outdoor unit and grouped into at least one indoor unit group, wherein the outdoor unit is provided with master/slave setting means for setting a master unit in the indoor unit group.

According to the above air conditioner, for example, the outdoor unit communicates with each indoor unit and a master/slave setting operation for each indoor unit is performed on the basis of the communication result. Accordingly, it is unnecessary for a setup operator to perform a master/slave switching operation, and the mingling of the control instruction due to an erroneous setup work can be perfectly prevented.

According to an eighth aspect of the present invention, an air conditioner includes an outdoor unit and plural indoor units which are connected to the outdoor unit and grouped into at least one indoor unit group, wherein master/slave setting means for setting a master unit in the indoor unit group is provided in driving control means of the outdoor unit, and the master/salve setting means outputs a check command through a predetermined indoor unit to an indoor unit which is connected to the predetermined indoor unit by a remote control circuit, and performs the master/slave setting operation on the predetermined indoor unit in accordance with a response command to the check command.

Further, according to a ninth aspect of the present invention, an air conditioner includes an outdoor unit and plural indoor units which are connected to the outdoor unit and grouped into at least one indoor unit group, wherein master/slave setting means for setting a master unit in the indoor unit group is provided in driving control means of the outdoor unit, and the master/salve setting means outputs a check command through a predetermined indoor unit to an indoor unit which is connected to the predetermined indoor unit by a remote control circuit, judges on the basis of the presence or absence of a response command to the check command whether the predetermined indoor unit is grouped, and then sets the predetermined indoor unit as a master unit on the basis of the judgment that the set data of the indoor unit outputting the response command indicates no master unit in the case where the predetermined indoor unit is grouped.

BRIEF DESCRIPTION OF THE DRAWINGS

FIG. 9A shows an example of a check command output from an outdoor unit to an indoor unit;

FIG. 9B shows an example of a converted check command output from an indoor unit to an indoor unit;

FIG. 9C shows an example of a response command output from an indoor unit to an indoor unit;

FIG. 9D shows an example of a response command output from an indoor unit to an indoor unit;

FIG. 9E shows an example of a converted response command output from an indoor unit to an outdoor unit; and FIG. 9F shows an example of a converted response command output from an indoor unit to an outdoor unit.

DETAILED DESCRIPTION OF PREFERRED EMBODIMENTS

Preferred embodiments according to the present invention will be described hereunder with reference to the accompanying drawings.

Figure 1:
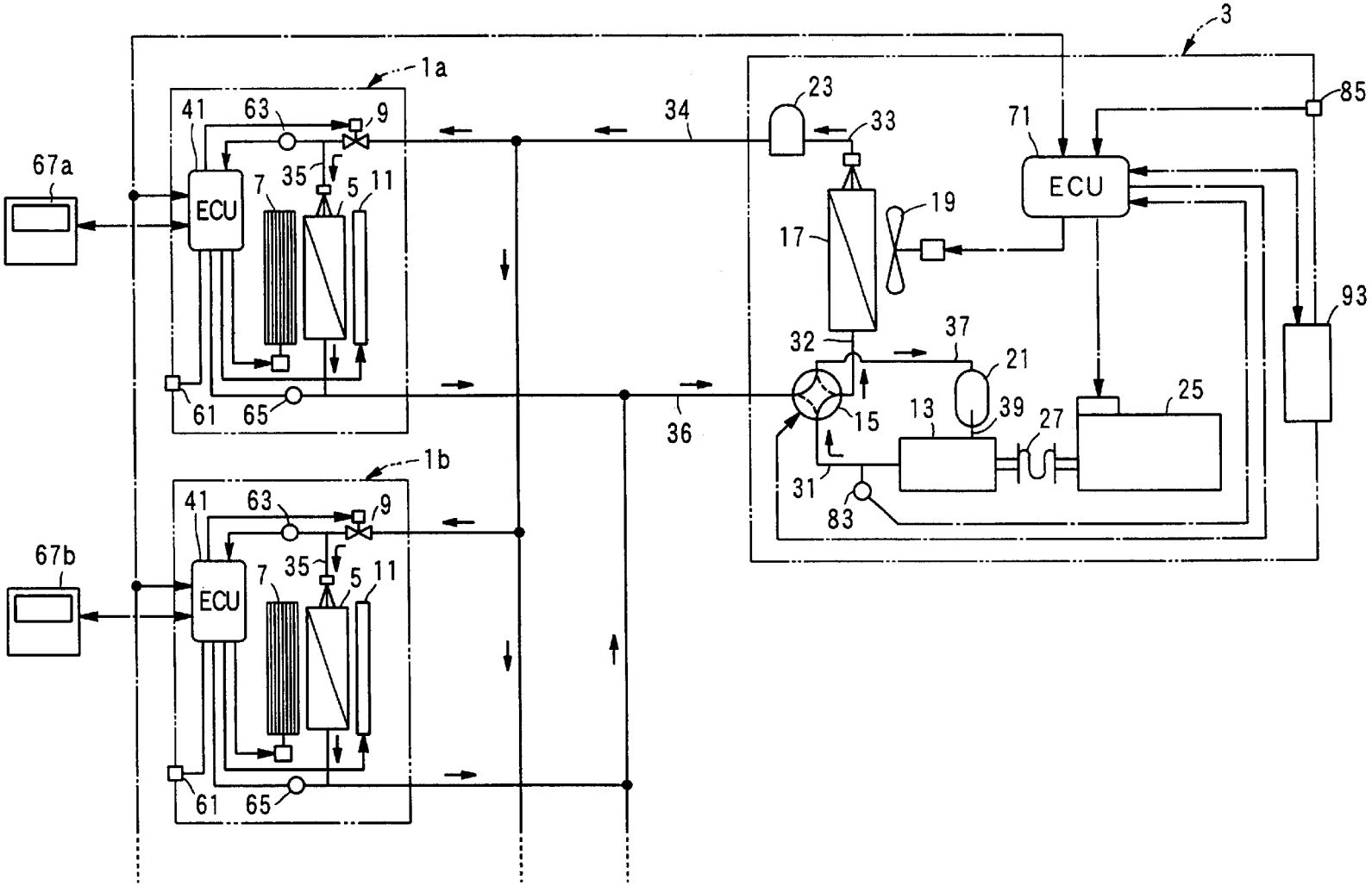
FIG. 1 is a schematic diagram showing an air conditioner according to a first embodiment of the present invention.

FIG. 1 is a schematic diagram showing a gas heat pump type air conditioner comprising plural indoor units 1*a*, 1*b*, . . . (hereinafter represented by 1*a*) and one outdoor unit 3. In FIG. 1, a solid line represents a refrigerant circuit, and a one-dotted chain line represents an electrical circuit.

An indoor heat exchanger 5, a motor-operated fan 7, a motor-operated expansion valve 9, an electrical heater 11, etc. are disposed at the indoor unit 1*a* side. Further, a compressor 13, an electromagnetic type four-way change-over valve 15, an outdoor heat exchanger 17, a motor-operated fan 19, an accumulator 21, a receiver tank 23, etc. are disposed at the outdoor unit 3 side. The units constituting the refrigerant circuit are connected to one another through refrigerant pipes 31 to 39 which are used to flow gas refrigerant or liquid refrigerant. In FIG. 1, reference numeral 25 represents a gas engine, and it drives the compressor 13 through a flexible coupling 27.

Figure 2:
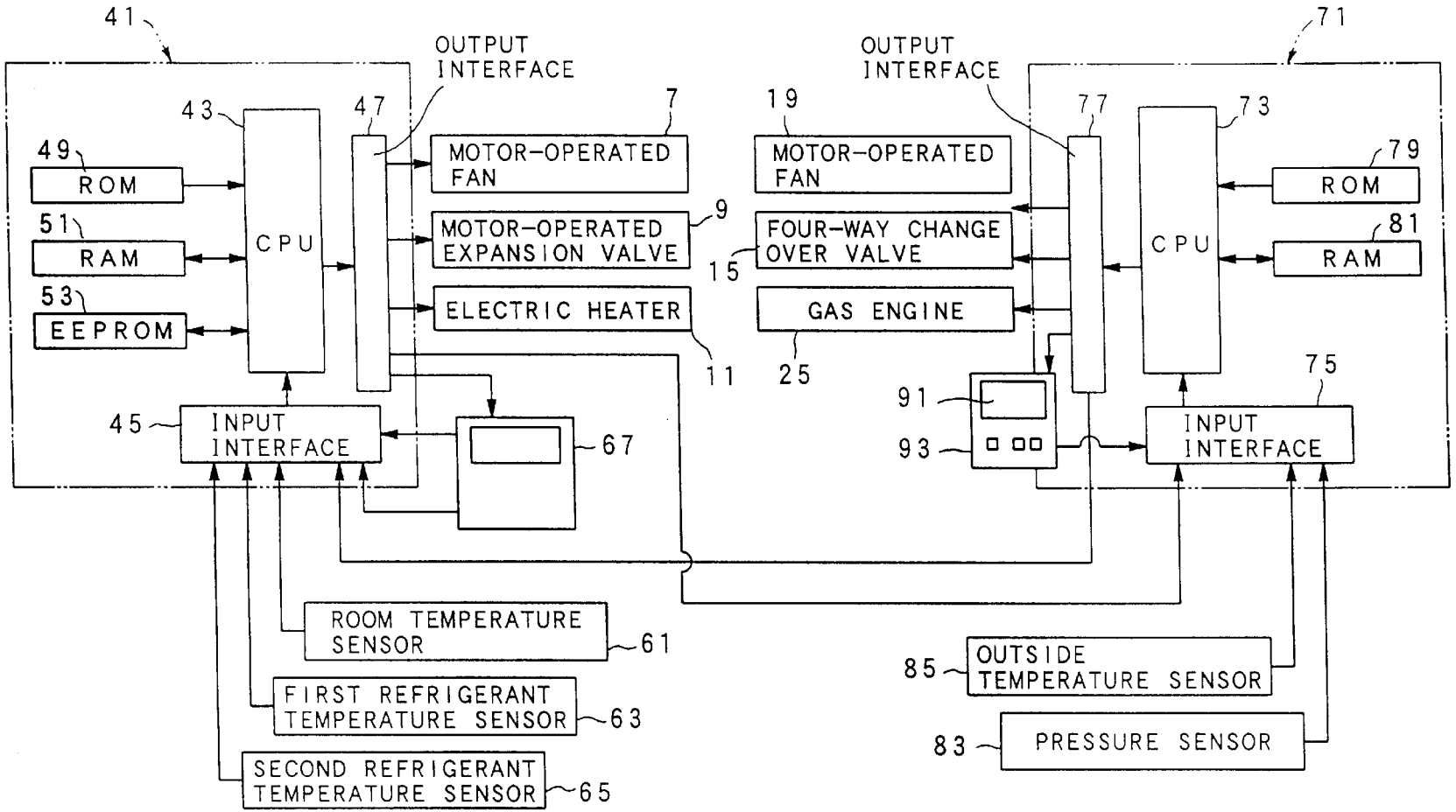
FIG. 2 is a block diagram showing signal flow between an indoor ECU and an outdoor ECU.

An indoor control unit (hereinafter referred t as "indoor ECU") 41 is disposed in the indoor unit 1*a*. A shown in FIG. 2, the indoor ECU 41 includes CPU 43, input/output interfaces 45, 47, ROM 49, RAM 51, EEPROM 53 (non-volatile storage device), etc. Various kinds of operation control programs, etc. are stored in the ROM 49, and various operation control parameters (for example, an indoor code C1*i* which is the code corresponding to the type (model and capacity) of the indoor unit 1*a*, etc.) are recorded in the EEPROM 53 by a ROM writer or the like which is provided on a fabrication line.

The input interface 45 of the indoor ECU 41 is connected to a room temperature sensor 61 for detecting the room temperature Tr, first and second refrigerant temperature sensors 63 and 65 for detecting the refrigerant temperature Tri, Tfo at the inlet side and the outlet side of the indoor heat exchanger 5 under cooling operation, a remote controller 67*a* (input system), etc. The output interface 47 of the indoor ECU 41 is connected to the motor-operated fan 7, the motor-operated expansion valve 9, the electric heater 11, the remote controller 67*a* (display system), etc.

Further, an outdoor control unit (hereinafter referred to as "outdoor ECU") 71 is disposed in the outdoor unit 3. The outdoor ECU 71 comprises a CPU 73, input/output interfaces 75, 77, ROM 79, RAM 81, etc. as in the case of the indoor ECU 41.

The input interface 75 of the outdoor ECU 71 is connected to a pressure sensor 83 for detecting a discharge-side refrigerant pressure Pd of the compressor 13, an outside temperature sensor 85 for detecting the outside temperature Ta, a control panel 93 having a display 91, etc. The output interface 77 of the outdoor ECU 71 is connected to the four-way change-over valve 15, the motor-operated fan 19, the gas engine 25, the control panel 93, etc. The indoor ECU 41 and the outdoor ECU 71 are connected to each other through the input/output interfaces 45, 47, 75 and 77 by serial communication to perform mutually communicate signals therebetween.

Next, the flow of refrigerant in cooling operation will be described.

Gas refrigerant which is sucked from the refrigerant pipe 39 into the compressor 13 is subjected to adiabatic compression to be discharged as high-temperature and high-pressure gas refrigerant from the compressor 13, and then flows through the refrigerant pipe 31, the four-way change-over valve 15 and the refrigerant pipe 32 into the outdoor heat exchanger 17. The high-temperature and high-pressure gas refrigerant is cooled by the outside air to be condensed into liquid refrigerant while passing through the outdoor heat exchanger 17, and then flows through the refrigerant pipe 33, the receiver tank 23 and the refrigerant pipe 34 into the motor-operated expansion valve 9.

The liquid refrigerant is adjusted in flow amount by the motor-operated expansion valve 9, and then flows through the refrigerant pipe 35 into the indoor heat exchanger 7. The liquid refrigerant is vaporized into gas refrigerant while passing through the indoor heat exchanger 7, whereby the indoor air blown by the motor-operated fan 7 is cooled by vaporization latent heat of the refrigerant. At this time, the indoor ECU 41 controls the rotational number (rpm) of the motor-operated fan 7 on the basis of the deviation between the set temperature Ts and the room temperature Tr, and also controls the valve opening degree of the motor-operated expansion valve 9 (the step number of a step motor for driving a valve disc) so that the deviation between the refrigerant temperature Tfi at the inlet side of the indoor heat exchanger 7 and the refrigerant temperature Tfo at the outlet side of the indoor heat exchanger 7 is equal to a predetermined value (for example, 0 to 1° C.).

The gas refrigerant which is vaporized in the indoor heat exchanger 7 flows through the refrigerant pipe 36, the four-way change-over valve 15 and the refrigerant pipe 37 into the accumulator 21, and then sucked from the refrigerant pipe 39 into the compressor 13 again.

According to the air conditioner of this embodiment, when the operation control parameter of the indoor unit 1*a* is changed, an operator inputs desired data from the control panel 93 of the outdoor unit. That is, the operator operates a parameter changing switch 94, a call button 95, and first and second setting buttons 97, 99 according to a predetermined procedure while looking at a 7-segment display. In this embodiment, the control panel 93 is simplified, however, various switches corresponding to various functions are actually disposed on the control panel 93.

Figure 3:
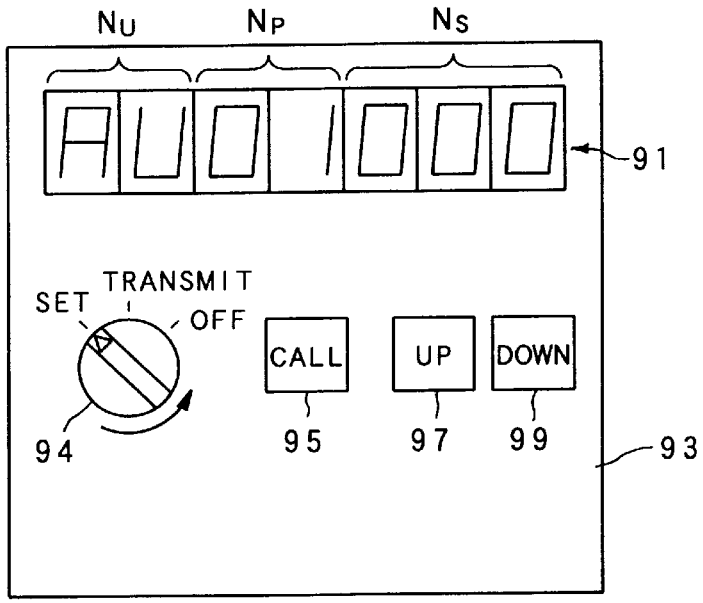
FIG. 3 is a plan view showing a control panel of an outdoor unit.

When the operator sets the parameter changing switch 94 to a set position, each of the unit number of the indoor unit 1*a* (NU) and the type of the operation control parameter (parameter number NP) is displayed on the display 91 by double digits. In a default state (in a state where no call button 95 is pushed), "AU" representing all the indoor units and "01" representing the first parameter are displayed as the unit number NU and the parameter number NP on the display 91. In FIG. 3, the triple digits which are subsequent to the parameter number NP represent the current set value NS (which was renewed at the shipping stage from a factory or previously).

Figure 4:
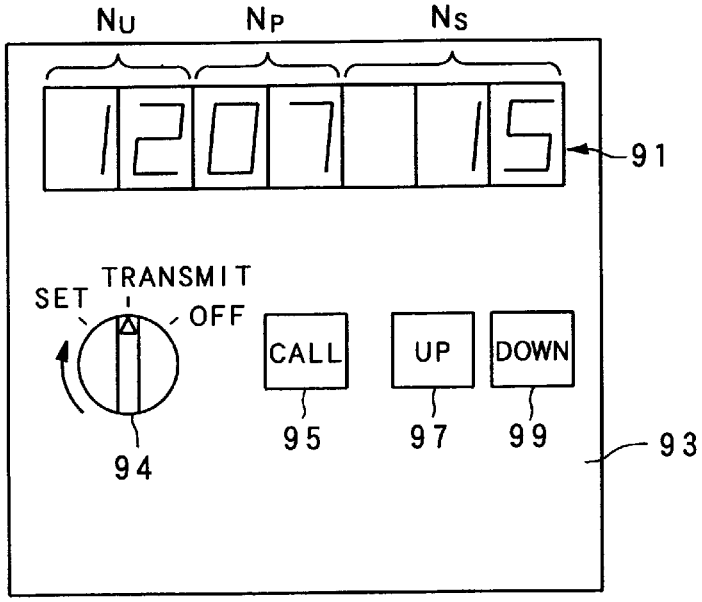
FIG. 4 is a plan view showing a control panel of an outdoor unit.

When the operator repetitively pushes the call button 95 from the default state, the display of the parameter number NP on the display 91 is successively incremented like (02→03→04 . . . ). When the display of the parameter numbers NP corresponding to all the operation control parameters is finished and further the call button 95 is pushed, the display of the unit number NU on the display 91 is shifted to "01" which represents the first indoor unit, and the parameter number NP is set to "01" which represents the first operation control parameter. By continuing to press the call button 95 from the above state, the display of the unit number NU is shifted to "02" representing the second indoor unit when the display of all the parameter numbers NP for the first indoor unit is finished. In the same manner as described above, the operator can set any unit number NU and any parameter number NP. For example, FIG. 4 shows a state where a seventh operation control parameter of a twelfth indoor unit is displayed on the display 91.

When the specification of the unit number NU and the parameter number NP is finished, the operator pushes a first set button 97 or a second set button 99 to change the set value NS to a desired value. For example, if the seventh operation control parameter represents the output interval of a filter cleaning sign, and the set value of the output interval is increased every 100 hours every time the first set button 97 is pushed, and decreased every 100 hours every time the second set button 99 is pushed. In this case, the set value NS is displayed with 100 hours set as an unit, and in the default state of FIG. 4, the filter cleaning sign is output every time the air conditioner is operated for 1500 hours.

After the setting of the operation control parameter is finished, the operator sets the parameter change switch 94 to a transmission position. At this time, the changed operation control parameter is transmitted from the CPU 73 of the outdoor ECU 71 to the CPU 41 of the indoor ECU 41, and then the CPU 41 renews the data in the EEPROM 53, whereby the air conditioner is controlled on the basis of the renewed operation control parameter so that it operates in the optimum state.

On the other hand, when the operation control parameters of all the indoor units are required to be changed to the same value, the operator sets the unit number NU to "AU". Accordingly, it is unnecessary for the operator to individually specify each individual indoor unit, so that the parameter setting work can be performed in a very short time.

As described above, according to this embodiment, by merely operating the control panel of the outdoor unit, the operator can change the operation control parameters of the respective indoor units easily and in a short time without going to many rooms where the indoor units are mounted. Further, the operation control parameter can be changed for a indoor unit having no remote controller in the same manner as described above, so that no preliminary remote controller is required and also it is unnecessary to connect the preliminary remote controller to the indoor unit.

In the above embodiment, the air conditioner is of a gas heat pump type. However, it may be an air conditioner having a motor-operated compressor, and further it may be an air conditioner having plural outdoor units. Further, in the above embodiment, the unit number and the parameter number are input by using a single call button, however, they may be input by using call buttons which are independently provided, and the display on the display unit may be performed with characters or the like. Still further, in the above embodiment, the change of the operation control parameter is performed every indoor unit or on all the indoor units. However, the indoor units may be grouped into some groups so that the change of the operation control parameters is performed every group. Still further, the specific construction of the air conditioner and the operation procedure thereof may be modified or changed without departing from the subject matter of the present invention.

Next, a second embodiment of the air conditioner according to the present invention will be described.

The basic construction of the outdoor ECU and the indoor ECU of this embodiment is the same as the first embodiment (see FIGS. 1 and 2) except that in addition to the above operation control programs, several hundreds and several tens kinds of operation control parameters Pdc corresponding to indoor units to which the outdoor unit is connectable are further stored in the ROM 79, and the flow of the refrigerant in cooling operation is the same as the first embodiment. The description of these overlap portions is omitted from the following described to avoid the duplicative description thereof. The same or like reference numerals are represented by the same reference numerals.

The operation of the air conditioner of the second embodiment will be described hereunder.

Figure 5:
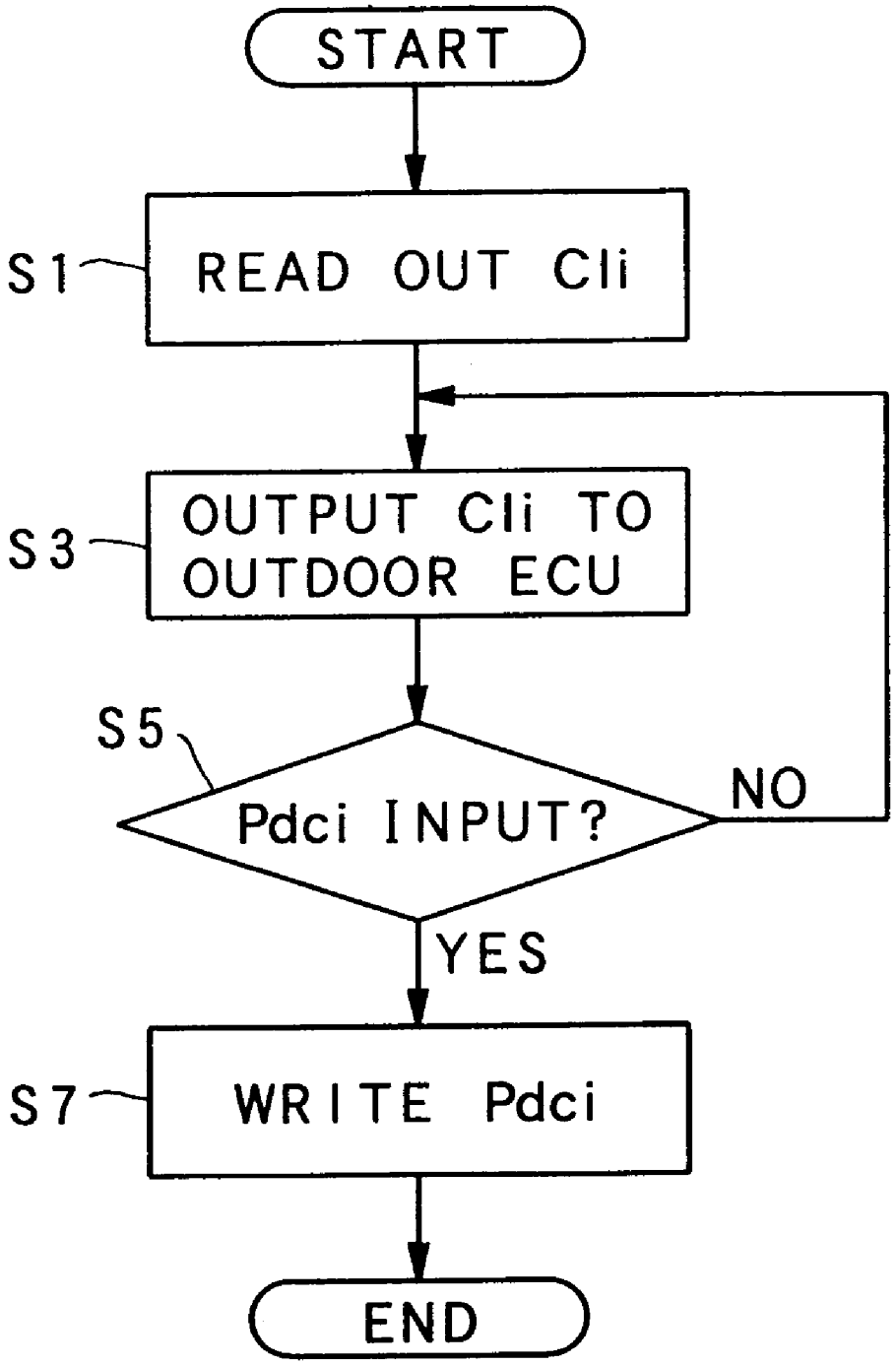
FIG. 5 is a flowchart showing the flow of a parameter writing control subroutine of an air conditioner according to a second embodiment of the present invention.

In the second embodiment, the indoor unit 1*a* and the outdoor unit 3 are connected to each other, and then when the indoor unit 1*a* is powered on, a parameter writing control subroutine shown in FIG. 5 is repetitively performed at a predetermined interval (for example, 5 seconds) in the indoor ECU 41.

Upon starting the subroutine, at the indoor unit 1*a* side, the CPU 43 of the indoor ECU 41 first reads out the indoor code C1*i* from EEPROM 53 in step S1, and then outputs the indoor code C1*i* to the CPU 73 of the outdoor ECU 71. At the outdoor unit 3 side, the CPU 73 of the outdoor ECU 71 identifies the indoor unit 1*a* which outputs the indoor code C1*i*, and also it searches the operation control parameter Pdci corresponding to the indoor code C1*i* from the ROM 79 and outputs the operation control parameter Pdci to the CPU 43 of the indoor unit 1*a*.

The CPU 43 of the indoor ECU 41 judges in step S5 whether the operation control parameter Pdci is input from the CPU 73 of the outdoor ECU 71, and it returns to the step S3 to repeat the output of the indoor code C1*i* to the CPU 73 while the judgment in step S5 is No (negative). When the operation control parameter Pdci is output from the outdoor ECU 71 and the judgment in step S5 is YES (positive), the CPU 43 writes the operation control parameter Pdci into the RAM 51 in step S7, and then finishes this subroutine.

Accordingly, the indoor ECU 41 controls the operation of the indoor unit 1*a* on the basis of the operation control parameter Pdci until the main power source is turned off. That is, the indoor ECU 41 controls the driving of the various units (the motor-operated fan 7, the motor-operated expansion valve 9, the electric heater 11, etc.) in accordance with the detection information of the sensors of both the units 1 and 3 (the room temperature sensor 61, the first and second refrigerant temperature sensors 63 and 65, the pressure sensor 83, the outside temperature sensor 85, etc.) in addition to the model and capacity of the indoor unit 1*a*. in addition to the model and capacity of the indoor unit 1*a*.

As described above, in the air conditioner of this embodiment, many operation control parameters are stored in the ECU of the outdoor unit in advance, and these parameters are output to the ECU of each indoor unit and stored in the RAM of the indoor unit. Accordingly, the capacity of the ROM of the indoor unit can be reduced while making uniform the ECUs (control boards) of the indoor units, whereby the manufacturing cost can be reduced.

In the above embodiment, the air conditioner is of a gas heat pump type. However, it may be an air conditioner having a motor-operated compressor, and further it may be an air conditioner having plural outdoor units. Further, in the above embodiment, the operation control parameter is stored in the RAM of the ECU of the indoor unit, however, it may be stored in non-volatile storing means such as EEPROM or the like. Further, the specific construction, the control procedure, etc. may be modified or changed without departing from the subject matter of the present invention.

Next, a third embodiment of the air conditioner according to the present invention will be described hereunder.

Figure 6:
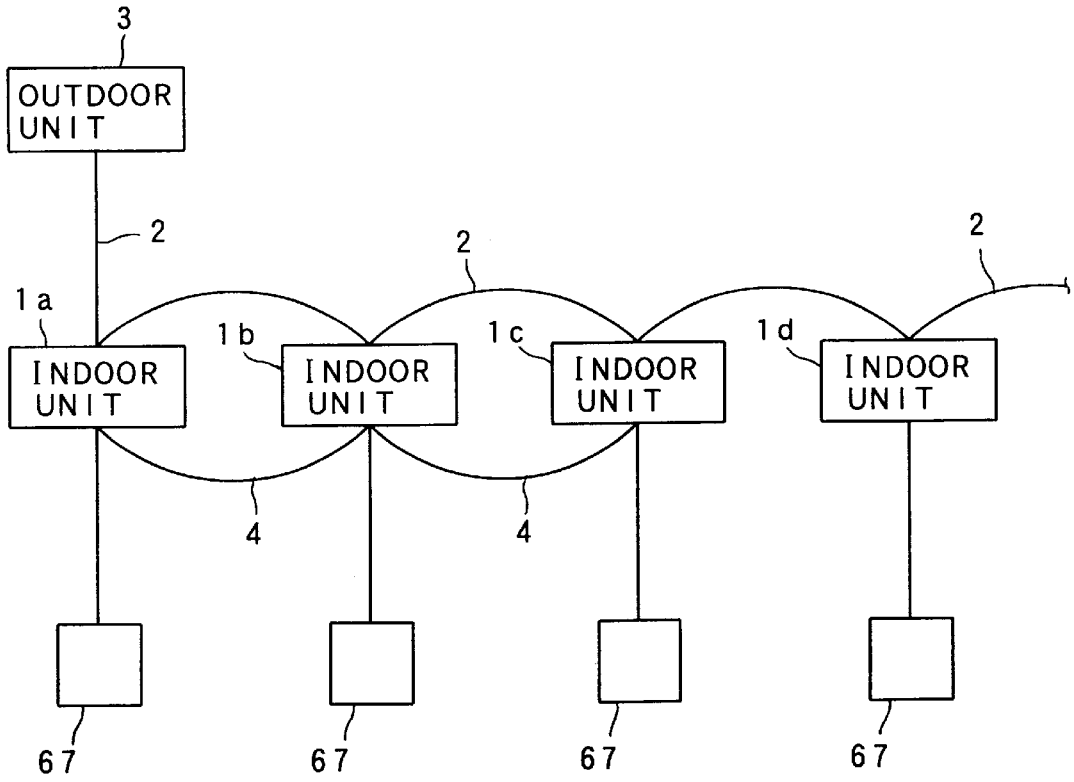
FIG. 6 is a schematic diagram showing a communication system of an air conditioner according to a third embodiment of the present invention.
Figure 7:
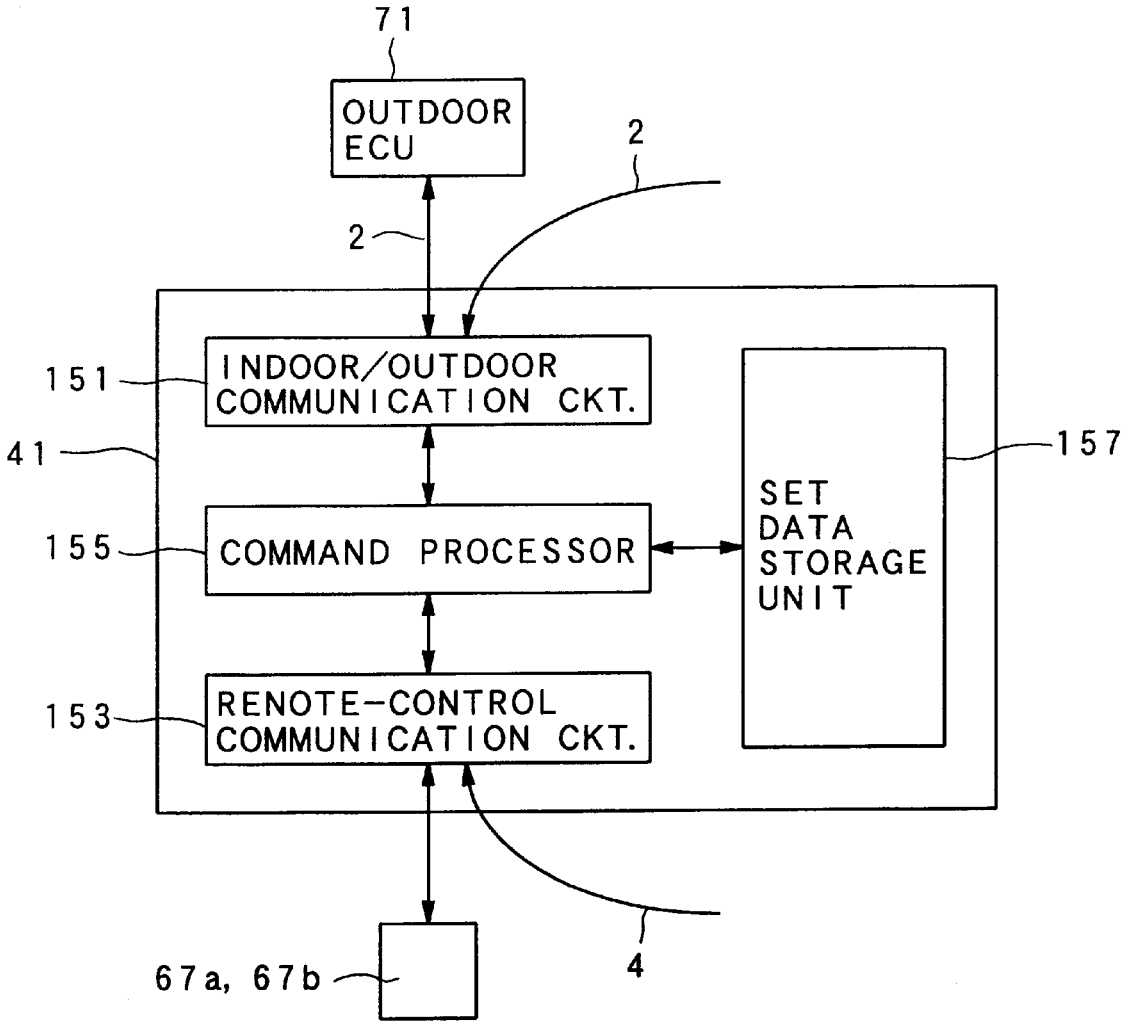
FIG. 7 is a schematic diagram showing a communication circuit, etc. in the indoor ECU 41.

FIG. 6 is a schematic diagram showing a communication system of a gas heat pump type air conditioner. The basic construction of the air conditioner of this embodiment is the same as the first and second embodiments, and the flow of the refrigerant in cooling operation is the same as the first and second embodiments. The detailed description on these overlap portions is omitted from the following description in order to avoid the duplicative description.

As shown in FIG. 6, the air conditioner of this embodiment comprises one outdoor unit 3 and many indoor units 1*a* to 1*d*, . . . (all the indoor units are represented by the indoor units 1*a* to 1*d*). In FIG. 6, three indoor units 1*a* to 1*c* are grouped, and one indoor unit 1*d* is used singly. The outdoor unit 3 and the indoor units 1*a* to 1*d* are connected to one another through an indoor/outdoor communication bus line 2, and signals are communicated therebetween by serial communication. The indoor units 1*a* to 1*c* which constitute the indoor unit group are connected to one another through a remote-control communication bus line 4, and the signals are communicated therebetween by serial communication. Further, each of the indoor units 1*a* to 1*d* is added to a remote controller 67 so that a user can input operation instructions for operation/stop, temperature adjustment, etc.

As shown in FIG. 6, the indoor ECU 41 of each of the indoor units 1*a* to 1*d* contains an indoor/outdoor communication circuit 151, a remote-control communication circuit 153, a command processor 155 and a set data storage unit (EEPROM) 157. The indoor/outdoor communication circuit 151 is used to communicate with the outdoor ECU 71 and the other indoor/out communication circuits 51, and the remote-control communication circuit 53 is used to communicate with the remote controllers 67*a* and 67*b* and the other remote-control communication circuits 53. Further the command processor 55 processes commands input from the indoor/outdoor communication circuit 51 and the remote-control communication circuit 53, and also reads/writes set data from/into the set data storage unit 57.

Next, the master/slave setting operation between the indoor units through the outdoor unit will be described.

Figure 8:
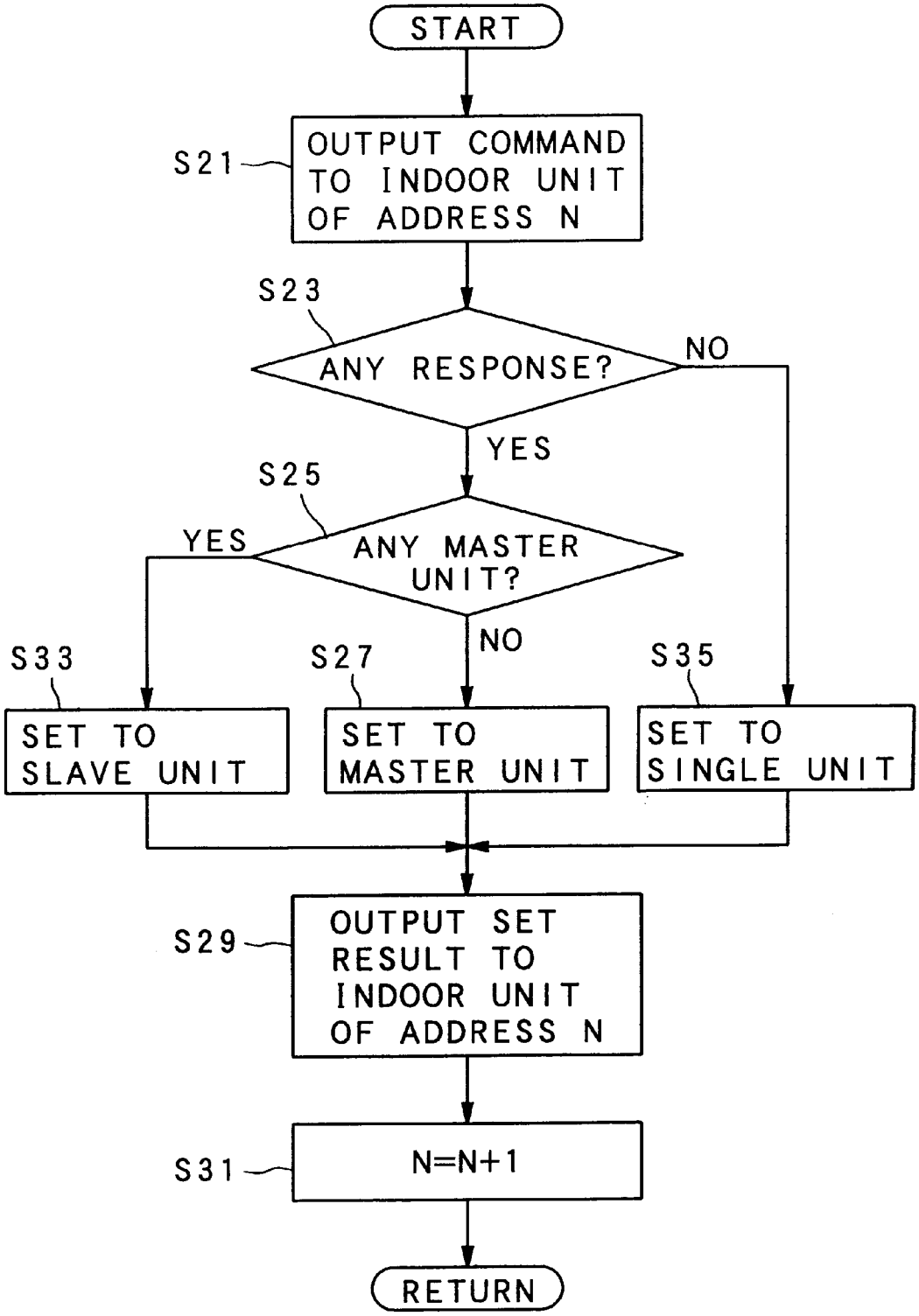
FIG. 8 is a flowchart showing the flow of a master/slave setting subroutine.

When the setup work of the air conditioner is completed and a main power source for the indoor units 1*a* to 1*d* and the outdoor unit 3 is turned on, the outdoor ECU 71 repetitively performs the master/slave setting subroutine show in FIG. 8 at a predetermined interval.

Upon start of the subroutine, the outdoor ECU 71 outputs a check command CB shown in FIG. 9A to an indoor unit of address N in step S21. Here, the initial value of the address N is set to 1, and it is beforehand set in each of the indoor units 1*a* to 1*d*. In this embodiment, the addresses corresponding to the indoor units 1*a* to 1*d* are assumed to be set to 1 to 4, respectively. In the check command CB and the response command CR as described later, the first item represents equipment (unit) which transmits the command, the second item represents equipment (unit) to which the command is directed, the third item represents the presence or absence of relay (i.e., whether the command is relayed or not), the fourth item represents equipment (unit) to which the command is directed when the command is relayed, or represents equipment (unit) serving as a transmitter when the command is not relayed, and the fifth item represents the content of the check or the set data.

The check command CB just after the main power source is turned on is output to the indoor unit of address 1, that is, the indoor ECU 41 of the indoor unit 1*a*. The check command CB at this time is directed from the outdoor unit 3 to all the indoor units while relayed through the indoor unit 1*a* to make all the indoor units check the set data therein as shown in FIG. 9A. In the indoor ECU 41 of the indoor unit 1*a,* the command processor 155 analyzes the check command CB input from the indoor/outdoor communication circuit 151 to convert the check command CB to a converted check command CB' shown in FIG. 9B because the check command CB is relayed, and then transmits the converted check command CB' from the remote-control communication circuit 153 through the remote-control communication bus line 4 to the indoor ECUs 41 of the indoor units 1*b*, 1*c*. The converted check command CB' is directed, with no relay, from the indoor unit 1*a* to all the indoor units which are connected to the indoor unit 1*a* through the remote-control communication bus line 4 on the assumption that the outdoor unit 3 is a transmitter, whereby the indoor units check the set data therein.

In the indoor ECUs 41 of the indoor units 1*b,* 1*c,* the converted check command CB' input from the indoor/outdoor communication circuit 151 is analyzed to output response commands CR shown in FIGS. 9C, 9D to the indoor ECU 41 of the indoor unit 1*a*. The response command CR at this time is directed from the indoor unit 1*b,* 1*c* to the outdoor unit 3 while relayed through the indoor unit 1*a* to make such a response that the set data are unsettled because the main power source has been just turned on. The indoor ECU 41 of the indoor unit 1*a* analyzes the response command CR to convert it to the converted response commands CR' shown in FIGS. 9E and 9F, and then transmits the converted response commands CR' to the outdoor ECU 71 of the outdoor unit 3. The converted response commands CR' at this time are directed from the indoor unit 1*a* to the outdoor unit 3 with no relay on the assumption that the indoor units 1*b* and 1*c* are transmitter to make such a response that the set data of the indoor unit 1*b,* 1*c* are unsettled.

The outdoor ECU 71 outputs the check command CB to the indoor unit of address 1 (indoor unit 1*a*) in step S21, and then judges whether there is a response in step S23. In this case, since there are two converted response commands CR', the judgment of the step S23 is YES (positive), and it is judged in step S25 whether a master unit has already existed. In this case, the converted response commands CR' from the indoor units 1*b,* 1*c* indicate that the set data are unsettled, and thus the judgment of the step S25 is NO (negative). Therefore, the indoor unit 1*a* is set as a master unit in step S27. Thereafter, the outdoor unit 3 outputs the set result to the indoor unit 1*a* in step S29, stores the set data (master unit) into the set data storing unit 57, and then increments the address N in step S31.

When the setting of the indoor unit 1*a* is finished, the outdoor unit ECU 71 subsequently outputs the check command CB to the indoor unit of address 2, that is, the indoor unit 1*b*. In this case, since the response command CR (converted response command CR') is input from the indoor unit 1*a,* 1*c* while relayed through the indoor unit 1*b,* the judgment of the step S23 is YES, and thus the outdoor unit 3 judges in step S25 whether a master unit has already existed. The set data of the indoor unit 1*a* indicates the master unit, and the judgment of the step S25 is YES, so that the outdoor unit 3 sets the indoor unit 1*b* as a slave unit in step S33. Thereafter, the outdoor unit 3 outputs the set result to the indoor unit 1*b* in step S29, stores the set data (slave unit) into the set data storing unit 57, and then increments the address N in step S31.

The outdoor unit also carries out the master/slave setting operation on the indoor unit 1*c* to set the indoor unit 1*c* as a slave unit in the same manner as described above, and then performs the master/slave setting operation on the indoor unit 1*d*. In this embodiment, even when the check command CB is output to the indoor unit 1*d,* no response command CR is input to the outdoor unit 3 because the indoor unit 1*d* is an independent unit. Accordingly, the judgment of the step S23 is NO, and the outdoor unit 3 judges in step S35 that the indoor unit 1*d* is a single unit, and outputs the set result to the indoor unit 1*d* in step 29.

As described above, according to this embodiment, the master/slave judgment of the indoor units is automatically performed by the outdoor unit 3 when the main power source is turned on after the air conditioner is mounted. Therefore, it is unnecessary for the mounting operator to manipulate the master/slave change-over switches, and the mingling of the control instructions due to the error setting can be perfectly prevented.

In the above embodiment, the air conditioner is of a gas heat pump type. However, it may be an air conditioner having a motor-operated compressor, and further it may be an air conditioner having plural outdoor units. Further, the specific construction of the air conditioner, the operation procedure, etc. may be suitably modified or changed without departing from the subject matter of the present invention.

As described above, according to the air conditioner of the present invention, the air conditioner comprising an outdoor unit and plural indoor units connected to the outdoor unit, is provided with non-volatile storing means which is provided in control means of each indoor unit and serves to store operation control parameters of the indoor unit, and operation control parameter changing means which is provided in the outdoor unit and serves to change the storage content of the non-volatile storing means to the indoor unit. Therefore, the work of changing the operation control parameters of the indoor units can be easily performed in a short time, and the labor of a maintenance work and the maintenance cost can be reduced.

Further, according to the air conditioner of the present invention, many operation control parameters are stored in the ECU of the outdoor unit in advance, and these parameters are output to the ECUs of the respective indoor units and stored in the RAMs thereof, so that the capacity of the ROM can be reduced while the ECU (control boards) of the indoor units are made uniform, and the manufacturing cost can be reduced.

Still further, according to the air conditioner of the present invention, the air conditioner including an outdoor unit and plural indoor units which are connected to the outdoor unit and grouped into at least one group, is further provided with master/slave setting means for setting a master unit in the indoor unit group, so that it is unnecessary for the setup operator to manipulating the master/slave change-over switches of the indoor units and thus the control instructions can be perfectly prevented from being mingled with one another due to the error setting.

What is claimed is:

1. An air conditioner including an outdoor unit and plural indoor units which are connected to said outdoor unit, said outdoor unit having indoor unit operation setting means for setting the driving operation of each said indoor units and each of said indoor units having driving control means which includes a non-volatile storing means for storing a default value of operation control parameters of said indoor units, said driving control means of said indoor units exclusively controlling operation of said indoor units on the basis of the operation control parameters stored in said indoor units.

2. The air conditioner as claimed in claim 1, wherein said indoor unit operation setting means has operation control parameter changing means for changing the storage content of said non-volatile storing means of each of said indoor units.

3. The air conditioner as claimed in claim 2, wherein said operation control parameter changing means selectively changes the storage content of said non-volatile storing means of a given indoor unit.

4. The air conditioner as claimed in claim 2, wherein said operation control parameter changing means changes the storage content of said non-volatile storing means on all of said indoor units collectively.

5. The air conditioner as claimed in claim 2, wherein said indoor units are grouped into at least one group and said operation control parameter changing means changes the storage content of said non-volatile storing means of the indoor units of said at least one group.

6. The air conditioner as claimed in claim 1, wherein said plural indoor units comprise different types of indoor units with the types differing in models and capacity, and said indoor unit operation setting means of said outdoor unit comprises:

storing means for storing plural operation control parameters which correspond to the respective types of indoor units, type identifying means for identifying the type of each of said indoor units, operation control parameter selecting means for selecting the operation control parameter corresponding to the type of each of said indoor units from said storing means on the basis of the identification result of said type identifying means, and operation control parameter output means for outputting the selected operation control parameter to each of said indoor units.

7. The air conditioner as claimed in claim 6, wherein driving control means of each of said indoor units comprises:

writable storing means for storing an operation control parameter input from said outdoor unit; and operation control means for performing operation control of each of said indoor units on the basis of the operation control parameter stored in said writable storing means.

8. The air conditioner as claimed in claim 1, wherein said plural indoor units are grouped into at least one indoor unit group, and said indoor unit operation setting means of said outdoor unit is provided with master/slave setting means for setting a master unit of said indoor unit group.

9. The air conditioner as claimed in claim 8, wherein said indoor unit operation setting means of said outdoor unit is provided in driving control means of said outdoor unit and said indoor unit operation control means is provided with master/slave setting means for setting a master unit of said indoor unit group, and wherein said master/slave setting means outputs a check command through a predetermined indoor unit to indoor units which are connected through a remote-control communication circuit to said predetermined indoor unit, and performs the master/slave setting operation of said indoor units in accordance with a response command to the check command.

10. The air conditioner as claimed in claim 8, wherein said indoor unit operation setting means of said outdoor unit is provided in driving control means of said outdoor unit, and said indoor unit operation control means is provided with master/slave setting means for setting a master unit of the indoor unit group, and wherein said master/salve setting means outputs a check command through a predetermined indoor unit to indoor units which are connected to said predetermined indoor unit by a remote control communication circuit, judges on the basis of the presence or absence of a response command to the check command whether said predetermined indoor unit is grouped, and then sets said predetermined indoor unit as a master unit on the basis of the judgment that the set data of the indoor unit outputting the response command indicates no master unit in the case where said predetermined indoor unit is grouped.

* * * * *